US005718722A

United States Patent [19]

Kiefer

[11] Patent Number: 5,718,722

[45] Date of Patent: Feb. 17, 1998

[54] LOWER BACK HEATER MAT WITH A LEG SUPPORT

[76] Inventor: John Steven Kiefer, 8410 Ferndale Cutoff, Little Rock, Ark. 72211

[21] Appl. No.: 712,482

[22] Filed: Sep. 11, 1996

[51] Int. Cl.[6] ..... A62H 29/00

[52] U.S. Cl. ..... 607/98; 607/96; 601/15; 219/217

[58] Field of Search ..... 607/96, 98, 99, 607/108, 112, 152; 219/201, 211, 217, 218, 443–444, 522; 601/15; 602/2

[56] References Cited

U.S. PATENT DOCUMENTS

| | | | |
|---|---|---|---|
| 1,526,132 | 2/1925 | Gilger | 219/217 |
| 3,621,192 | 11/1971 | Pohler | 219/217 |
| 4,030,487 | 6/1977 | McEachran | 601/15 |
| 4,306,747 | 12/1981 | Moss | 607/96 |
| 4,962,295 | 10/1990 | Gilmore | 219/217 |
| 5,380,269 | 1/1995 | Urso | 602/2 |

*Primary Examiner*—Jennifer Bahr
*Assistant Examiner*—David Ruddy
*Attorney, Agent, or Firm*—Goldstein & Associates

[57] ABSTRACT

A lower back heater mat with a leg support comprising a ladder shaped leg support and an electrical heater mat pivotally connected to the leg support. A person with lower back pain lying on the electrical heater mat is forced to elevate his or her legs on the leg support. The leg support and the electrical heater mat fold making allowing for easy transportation.

1 Claim, 3 Drawing Sheets

LOWER BACK HEATER MAT WITH A LEG SUPPORT

BACKGROUND OF THE INVENTION

The invention relates to a lower back heater mat with a leg support. More particularly, the invention relates to a cushioned mat with a lower back heater having a ladder shaped leg support which allows a person to elevate his or her legs while laying on the mat.

Lower back pain is a common and an extremely painful ailment. Second only to work-related injuries, lower back pain has the highest incidence of disability and economic loss in the United States. Approximately 21 million Americans experience lower back pain. The total annual cost (health care plus indirect costs) attributable to low back pain is about $20 billion. However, the cost of human suffering is truly inestimable.

Nearly everyone has experienced lower back pain at least once. Unfortunately, for many people lower back pain is chronic. Chiropractors and doctors provide generic advice to relieve the pain: elevating your legs to take the pressure of the vertebrae of your spine and apply heat to facilitate the healing process by increasing the blood circulation in the lower back area.

In response to the growing awareness of lower back problems, lounge chairs and seats having lumbar supports which provide heat and massage have appeared in the market. However, the healing and soothing effects of these devices are limited by their upright vertical nature. In a seated position, gravity compresses the vertebrae of the spine and hampers the natural deflammation process.

There is currently no product on the market which is specifically designed to take the pressure of the vertebrae of the spine and to allow an injured or fatigued back to rest and heal. Beds capable of contouring to various positions are in the market. However, these beds do not provide heat to the lower back area. Furthermore, beds capable of contouring are very expensive, bulky, and are not portable.

While these units may be suitable for the particular purpose employed, or for general use, they would not be as suitable for the purposes of the present invention as disclosed hereafter.

SUMMARY OF THE INVENTION

It is an object of the invention to produce a lower back heater mat with a leg support.

It is another object of the invention to provide a device which takes the pressure off the vertebrae of the spine and allows an injured or fatigued back to heal and rest.

It is a further object of the invention to provide a lower back heater mat with a leg support which is easily transportable.

It is a still further object of the invention to provide an entirely natural alternate to anti-inflammatory drugs for the reduction of lower back pain.

The invention is a lower back heater mat with a leg support comprising a ladder shaped leg support and an electrical heater mat pivotally connected to the leg support. A person with lower back pain lying on the electrical heater mat is forced to elevate his or her legs on the leg support. The leg support and the electrical heater mat fold making allowing for easy transportation.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
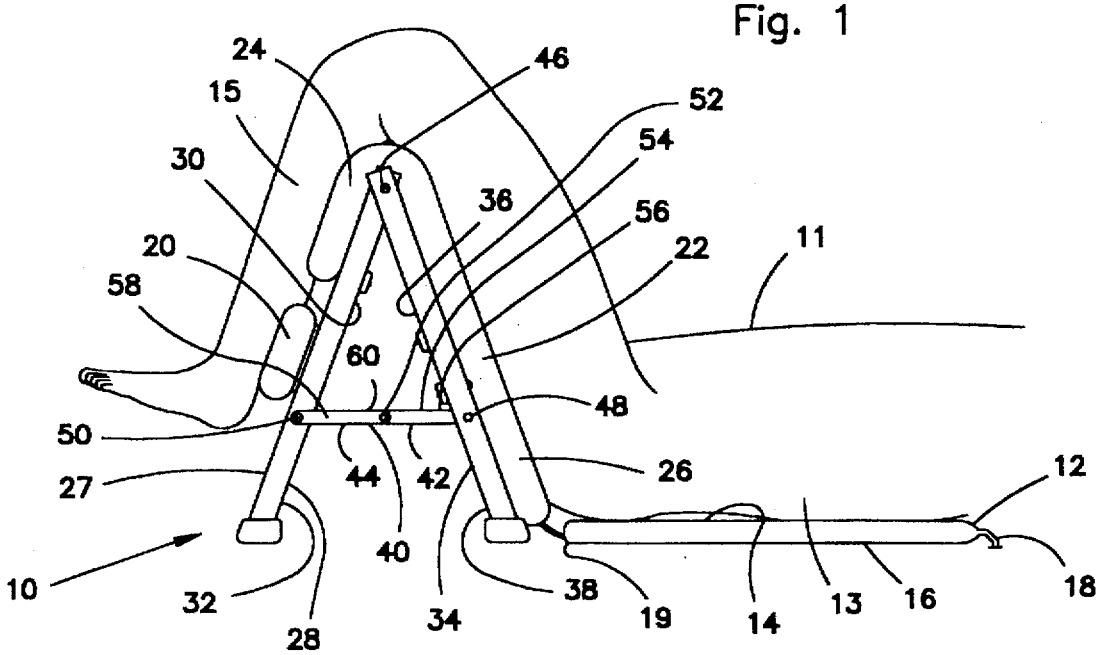
FIG. 1 is a side elevation view of a person lying on the lower back heater mat with legs elevated on the leg support.
Figure 5:
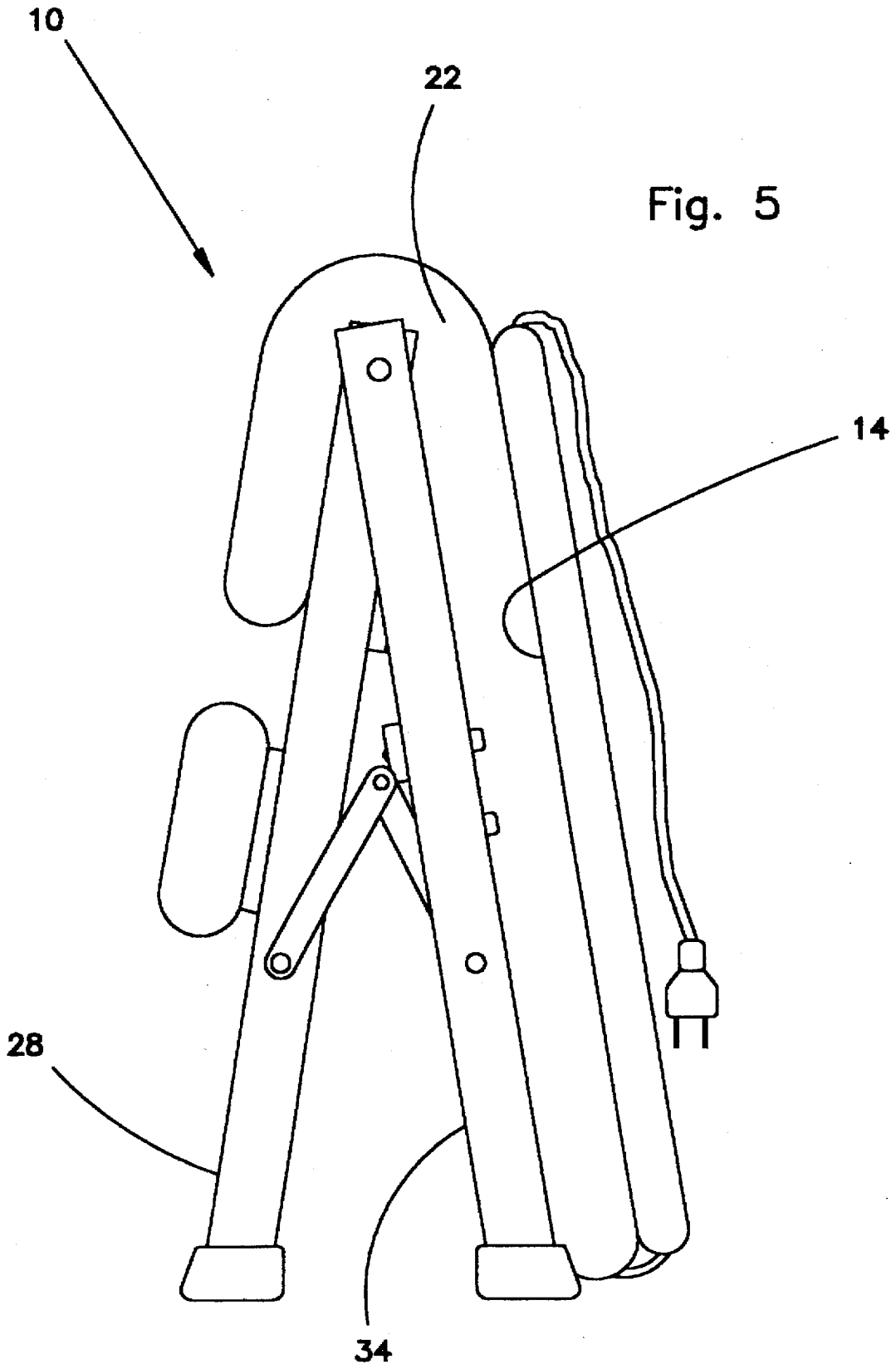
FIG. 5 is a side elevation view of the folded lower back heater mat with leg support.

FIG. 1 illustrates a person 11 lying on a lower back heater mat with leg support 10. The lower back heater mat with leg support 10 comprises a heater mat 12 and a ladder shaped leg support 27. The heater mat 12 has an upper surface 14, a lower surface 16, a first end 19, and a power cord 18. The ladder shaped leg support 27 has a pair of first legs 28 each having a top end 30 and a bottom end 32, a pair of second legs 34 each having a top end 36 and a bottom end 38, a stabilizing link 40 having a right end portion 42 and a left end portion 44, a first cushion 20, and a second cushion 22. The right end portion 42 of the stabilizing link 40 has a first end 54 and a second end 56. The left end portion 44 of the stabilizing link 40 has a first end 58 and a second end 60. The top end 30 of each first leg 28 is pivotally connected to the top end 36 of one of the second legs 34 at a first pivot point 46. The first legs 28 and the second legs 34 are pivotal relative to each other about the first pivot point 46 between an opened position, as illustrated in FIG. 1, and a closed position, as illustrated in FIG. 5. The second end 56 of the right end portion 42 of the stabilizing link 40 is pivotally connected to one of the second legs 34 at a second pivot point 48. The first end 58 of the left end portion 44 of the stabilizing link 40 is pivotally connected to one of the first legs 28 at a third pivot point 50. The left end portion 44 of the stabilizing link 40 and the right end portion 42 of the stabilizing link 40 are pivotal relative to each other about a fourth pivot point 52 between an opened position, as illustrated in FIG. 1, and a closed position, as illustrated in FIG. 5. The stabilizing link 40 prevents the pair of first legs 28 and the pair of second legs 34 from pivoting relative to each other about the first pivot point 46 beyond the opened position illustrated in FIG. 1. The stabilizing link 40 also stiffens and, thereby, further stabilizes the leg support 27 structure. The second cushion 22 has an upper end 24 and a lower end 26. The first cushion 20 is attached to the pair of first legs 28. The upper end 24 of the second cushion 22 is also attached to the pair of first legs 28. The lower end 26 of the second cushion 22 is attached to the pair of second legs 34. The first end 19 of the heater mat 12 is pivotally connected to lower end 26 of the second cushion 22. The heater mat 12 and the second cushion 22 are pivotal relative to each other between an opened position, as illustrated in FIG. 1, and a closed position, as illustrated in FIG. 5. A person's lower back 13 is shown in contact with the upper surface 14 of the heater mat 12. A person's legs 15 are supported and elevated on the leg support 27.

Figure 2:
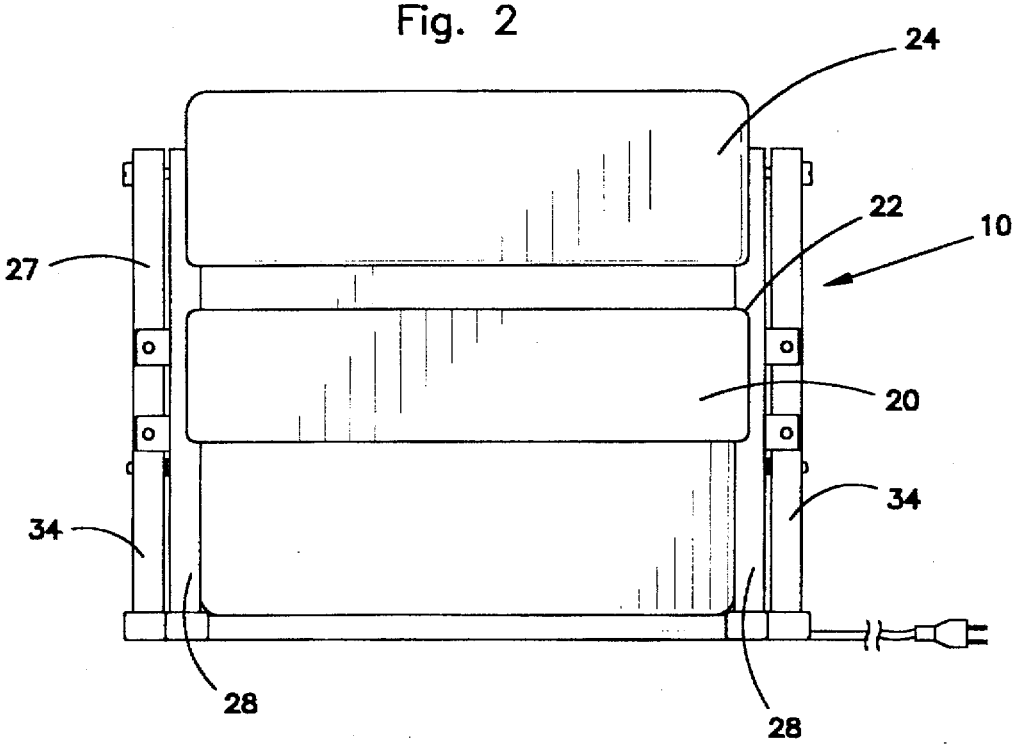
FIG. 2 is a back elevation view of the lower back heater mat with leg support.

FIG. 2 is a rear elevation view of the lower back heater mat with leg support 10. The pair of first legs 28 and the pair of second legs 34 are in the closed position. FIG. 5 also illustrates the pair of first legs 28 and the pair of second legs 34 in the closed position. The second cushion 22 and the heater mat 12 are in the opened position. FIG. 1 also illustrates the second cushion 22 and the heater mat 12 in the opened position. The pair of first legs 28 are parallel and are spaced a predetermined distance apart. The pair of second legs 34 are parallel and are space a predetermined distance apart. The first cushion 20 is attached between and connects the pair of first legs 28. The pair of first legs 28 lie in the same plane. The pair of second legs 34 lie in the same plane. The upper end 24 of the second cushion 22 is attached between the first legs 28 and connects them.

Figure 3:
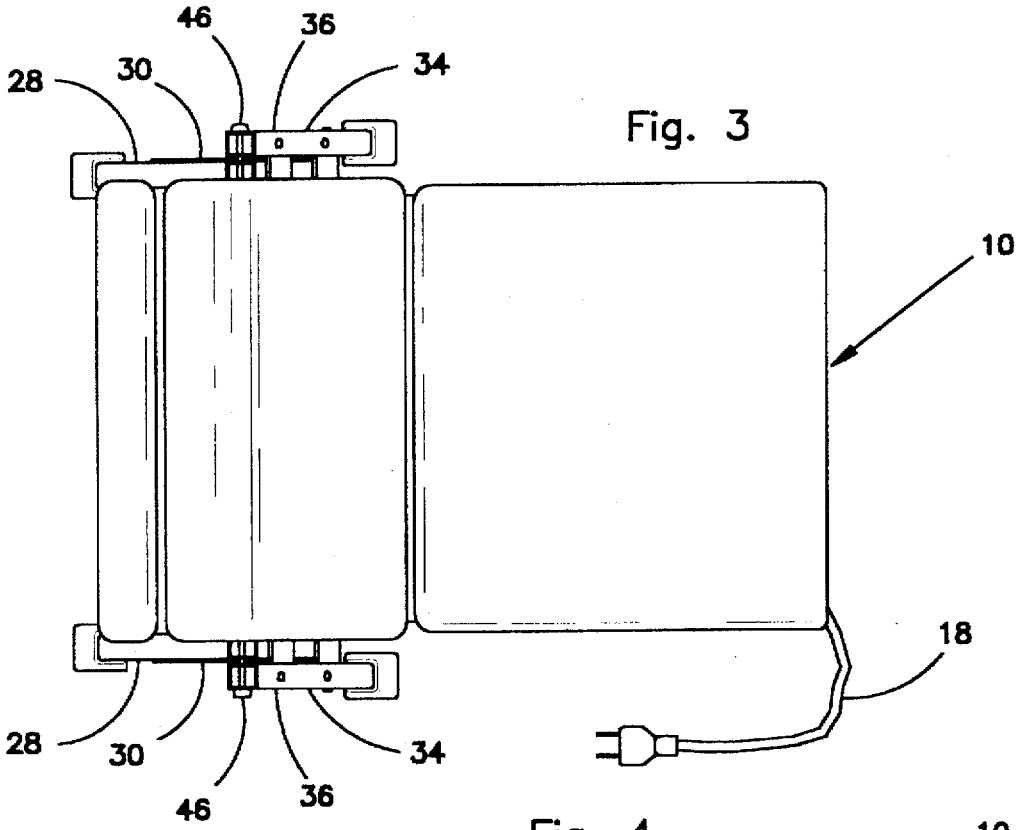
FIG. 3 is a plan view of the lower back heater mat with leg support.

FIG. 3 is a plan view of the lower back heater mat with leg support 10. The top end 30 of each first leg 28 can be seen again to be pivotally connected to the top end 36 of each second leg 34 at the first pivot point 46. The power cord 18 can also be seen extending from the heater mat 12.

Figure 4:
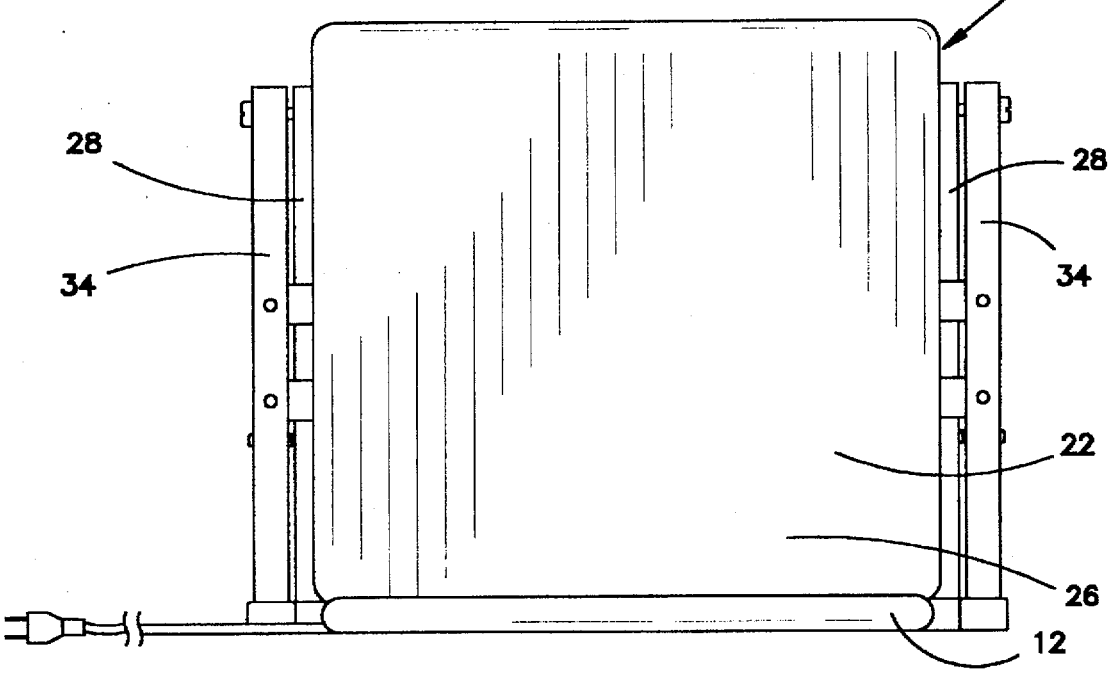
FIG. 4 is front elevation view of the lower back heater mat with leg support.

FIG. 4 is a front elevation view of the lower back heater mat with leg support 10. The pair of first legs 28 and the pair of second legs 34 are in the closed position. The second cushion 22 and the heater mat 12 are in the opened position. The lower end 26 of the second cushion 22 is attached between and connects the pair of second legs 34.

FIG. 5 illustrates the side elevation view of the closed/folded lower back heater with leg support 10. The pair of first legs 28 and the pair of second legs 34 are in the closed position. The second cushion 22 and the heater mat 12 are also in the closed position. The upper surface 14 of the heater mat 12 is in contact with the second cushion 22.

What is claimed is:

1. A lower back heating pad with leg support comprising:

an electric heating mat for providing heat to a person's lower back;

a pair of leg supports for supporting the legs of a person lying on the electric heating mat, said leg supports comprising a first leg with a first cushion and a second leg with a second cushion, said first and second legs being pivotally connected to each other, such that the first and second legs pivot between an open and closed position, said electric heating mat being pivotally connected to the leg supports by attachment to the second cushion, wherein said electric heating mat may be folded up against the leg supports allowing the heater pad with leg support to collapse for easy storage.

* * * * *